US011103055B2

(12) United States Patent
Richmond et al.

(10) Patent No.: US 11,103,055 B2
(45) Date of Patent: Aug. 31, 2021

(54) HAIR STYLING APPARATUS

(71) Applicant: Trade Box, LLC, Culver City, CA (US)

(72) Inventors: David Richmond, Culver City, CA (US); Howard Richmond, Los Angeles, CA (US); Manuel A. Montano, Gardena, CA (US)

(73) Assignee: Trade Boxy, LLC, Culver City, CA (US)

( * ) Notice: Subject to any disclaimer, the term of this patent is extended or adjusted under 35 U.S.C. 154(b) by 0 days.

(21) Appl. No.: 16/285,047

(22) Filed: Feb. 25, 2019

(65) Prior Publication Data

US 2020/0268136 A1 Aug. 27, 2020

(51) Int. Cl.

| | |
|---|---|
| ***A45D 2/00*** | (2006.01) |
| ***A46B 9/02*** | (2006.01) |
| ***A46B 13/08*** | (2006.01) |
| ***A45D 2/42*** | (2006.01) |

(52) U.S. Cl.

CPC ..... *A46B 9/025* (2013.01); *A45D 2/001* (2013.01); *A45D 2/42* (2013.01); *A46B 13/08* (2013.01); *A46B 2200/104* (2013.01)

(58) Field of Classification Search

CPC . A45D 2/001; A45D 2/42; A45D 2/44; A45D 7/02; A45D 24/00; A45D 24/007; A45D 19/02; A45D 2200/056; A45D 24/28; A45D 2200/058; A45D 24/22; A45D 2019/0083; A45D 19/0008; A46B 13/00; A46B 13/005; A46B 13/02; A46B 13/023; A46B 13/08; A46B 15/003; A46B 7/06; A46B 9/023; A46B 9/06; A61H 2201/02; A61C 17/36; A61C 17/3445

USPC ..... 132/120, 223, 270

See application file for complete search history.

(56) References Cited

U.S. PATENT DOCUMENTS

| | | | | | |
|---|---|---|---|---|---|
| 3,088,471 | A | * | 5/1963 | Fiore | A45D 8/12 132/136 |
| 3,272,023 | A | * | 9/1966 | Ferguson | A45D 24/007 74/55 |
| 3,524,088 | A | * | 8/1970 | Ryckman, Jr. | A61C 17/3445 310/50 |
| 3,794,050 | A | * | 2/1974 | Gallanis | A45D 24/007 132/119.1 |
| 3,840,030 | A | * | 10/1974 | Baker | A45D 20/50 132/118 |
| 3,850,181 | A | * | 11/1974 | Baker | A45D 24/007 132/119.1 |
| 3,964,502 | A | * | 6/1976 | Komatsu | A45D 20/50 132/119.1 |
| 5,881,426 | A | * | 3/1999 | Tong | A46B 9/023 15/201 |

(Continued)

FOREIGN PATENT DOCUMENTS

GB 2233548 * 1/1991

*Primary Examiner* — Yogesh P Patel
*Assistant Examiner* — Jennifer Gill
(74) *Attorney, Agent, or Firm* — Smyrski Law Group, A P.C.

(57) ABSTRACT

A hair styling apparatus is provided including a brush head, a plurality of tines located on the brush head, and a series of movable linearly arranged prongs having an angled orientation with respect to the brush head. A user causing movement of the linearly arranged prongs serves to secure the user' s hair against a subset of the plurality of tines.

20 Claims, 7 Drawing Sheets

(56) References Cited

U.S. PATENT DOCUMENTS

| | | | | |
|---|---|---|---|---|
| 8,209,877 | B2 * | 7/2012 | Smal | A45D 2/002 34/96 |
| D825,929 | S * | 8/2018 | Julemont | D4/100 |
| 2001/0035191 | A1 * | 11/2001 | Lee | A46B 9/023 132/160 |
| 2017/0042303 | A1 * | 2/2017 | Kock | A45D 1/04 |
| 2018/0153294 | A1 * | 6/2018 | Thomas | A46B 9/023 |

* cited by examiner

HAIR STYLING APPARATUS

BACKGROUND OF THE INVENTION

Field of the Invention

The present invention relates generally to the art of hair styling tools, and more specifically to devices employed for straightening a user's hair.

Description of the Related Art

Hair styling devices include devices that apply heat to a user's hair and come in different configurations. One such configuration is a hair straightening brush, which employs a series of brush protrusions or bristles arranged in parallel lines or regular arrangements and enable the user to place a strand of hair within these bristles and pull the brush away from his or her head, thus causing the styling brush to style the user's hair.

The bristles or tines of a hair straightening brush are generally positioned above a relatively flat surface which may include a slight curvature, commonly called a brush head. Most previous bristles have been relatively static in these types of brushes, fixed in a protruding orientation out of a base. Different shapes of bristles and protrusions have been employed. However, the ability to keep the hair close to the brush head has been a constant challenge. Hair closer to the brush head, and closer to the heating of the base, tends to improve the styling of the hair, tends to style the hair more quickly, and tends to be provide better styling attributes generally, as long as the hair is not too close to the heating element such that the hair "burns" or singes. However, in a brush arrangement, the bristles or protrusions tend to be pushed against the user's head, and the hair that is placed between the brush head surface the bristles or tines can include hair that is far from the bristles. Such an arrangement tends to be less than ideal, either requiring multiple passes of the hair straightening brush over the head, while consuming power or electricity, or some hair may not be styled while other hair is styled, leading to an odd or less than ideal resultant appearance.

Certain existing designs employ different types of bristles or protrusions, such as that shown by Glucksman, U.S. Pat. No. 8,267,098. The Glucksman design, for example, includes a number of tines that are stacked in their construction, namely one line of linearly arranged tines. A series of linear gaps are formed and the user pulls her hair through these gaps, seeking to style her hair.

Again, the issue with such a design is the lack of proximity between the hair and the heating elements. While some hair may pass close to the heating elements, some hair may not, which is undesirable. The result is either uneven styling of portions of the hair, or the need to repeatedly pass the device through the hair to obtain adequate styling, which increases exposure of hair to heat and increases costs, all of which are undesirable attributes.

A general challenge is the ability to provide an effective and efficient heating for different types of hair, with ability to provide heat in a relatively short amount of time. It would be advantageous to offer hair curling or hair straightening devices that address issues present in previous devices, particularly with respect to heating and styling of the hair in a desirably short amount of time.

SUMMARY OF THE INVENTION

According to the present design, there is provided a hair styling apparatus comprising a brush head, a plurality of tines located on the brush head, and a series of movable linearly arranged prongs having an angled orientation with respect to the brush head. A user causing movement of the linearly arranged prongs serves to secure the user's hair against a subset of the plurality of tines.

According to a further embodiment of the present design, there is provided a hair styling apparatus comprising a brush head, a plurality of tines disposed on the brush head, and a plurality of movable prongs emanating from the brush head, the plurality of movable prongs movable using a switch engageable by a user. The plurality of movable prongs is oriented in at least one linear configuration and is movable using the switch to secure and release hair of the user in conjunction with at least some of the plurality of tines.

According to another embodiment of the present design, there is provided a hair styling apparatus comprising a plurality of tines spaced apart on a brush head, and a plurality of prongs movable to secure a user's hair when the user's hair passes through at least some of the plurality of tines. The plurality of prongs are movable to secure and release the user's hair.

These and other advantages of the present invention will become apparent to those skilled in the art from the following detailed description of the invention and the accompanying drawings.

BRIEF DESCRIPTION OF THE DRAWINGS

The present invention is illustrated by way of example, and not by way of limitation, in the figures of the accompanying drawings in which.

The exemplification set out herein illustrates particular embodiments, and such exemplification is not intended to be construed as limiting in any manner.

DETAILED DESCRIPTION OF THE INVENTION

The following description and the drawings illustrate specific embodiments sufficiently to enable those skilled in the art to practice the system and method described. Other embodiments may incorporate structural, logical, process and other changes. Examples merely typify possible variations. Individual components and functions are generally optional unless explicitly required, and the sequence of operations may vary. Portions and features of some embodiments may be included in or substituted for those of others.

The present design is a styling brush that employs a number of movable compression elements, compression elements that serve to bring the hair close to the heating element, while at the same time offering a series of protrusions or tines that facilitate styling the hair in an efficient and effective manner. The protrusions are typically user initiated by a button provided, in that the hair is received in the brush when the compression elements are not engaged, the user engages the compression elements to bring the hair close to the surface of the brush and closer to the heating element, and the user then draws hair through the brush, heating more hair in a single brush stroke than had previously been achievable. Compression elements can take various forms, but typically act to draw the hair placed proximate the compression elements close to or closer to the heating element provided.

Figure 1:
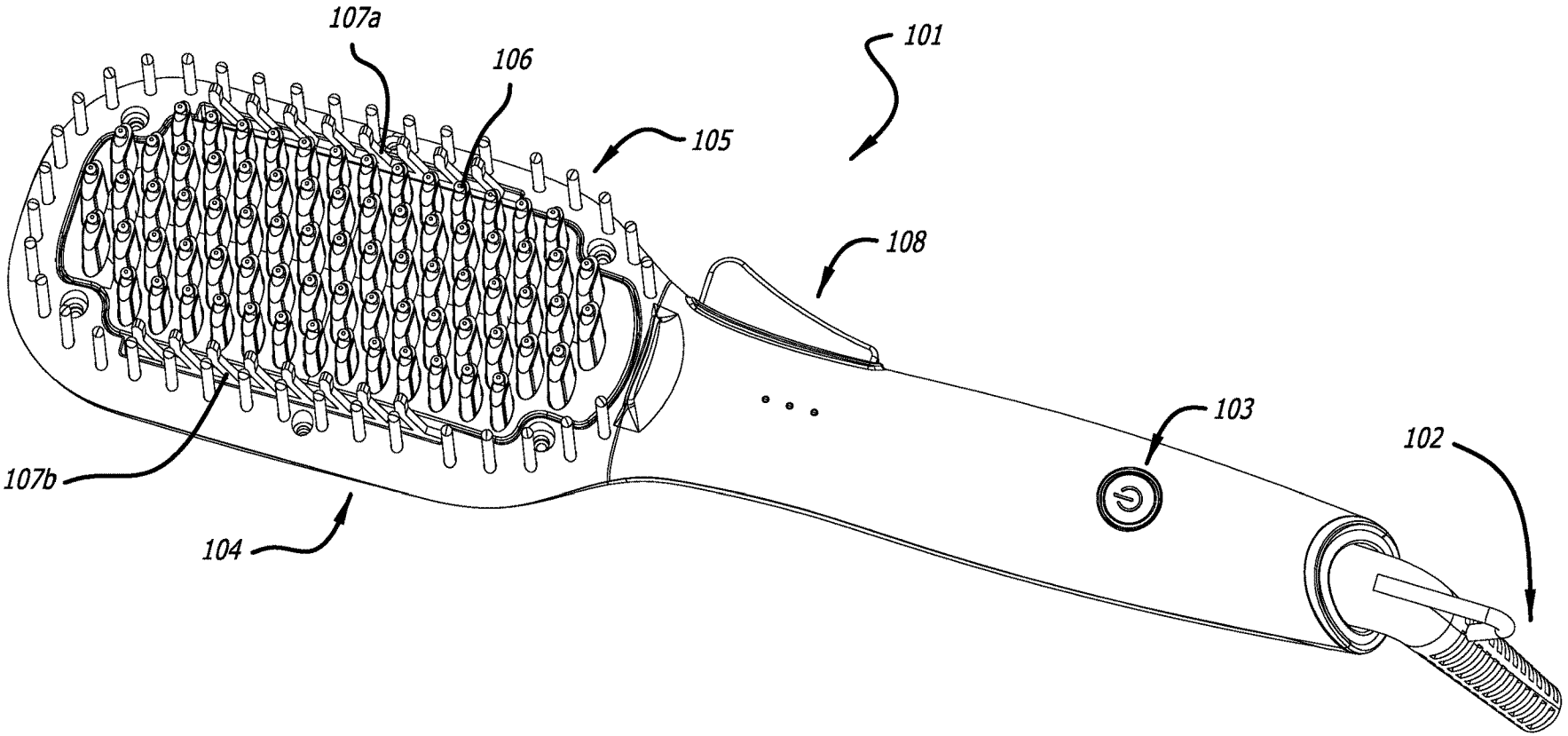
FIG. 1 illustrates an overall view of an embodiment of the present design.

FIG. 1 is a representation of such a device. From FIG. 1, there is provided a styling brush or hair brush 101, having power cord 102, power button 103, and brush head 104. FIG. 1 includes two different types of static protrusions or tines, represented by static protrusion 105, representing one of a series of static protrusions encircling the exterior of the top of the styling brush 101. Also provided are a series of rows of thicker static protrusions, represented by thicker static protrusion 106. These thicker static protrusions such as thicker static protrusion 106 and the static protrusions such as static protrusion 105 may take different forms and/or may be arranged differently, and may be uniform or different in size and shape. The general function of the static protrusions is to afford the user the ability to draw hair therethrough, much like a standard hair brush.

Also provided in FIG. 1 is a pair of rows of moveable hair retention elements 107*a* and 107*b*. In the representation of FIG. 1, each row includes eight hair retention elements mounted atop a single linear element that slides upward toward the top of brush head 104 and downward toward the base of brush head 104. Button 108 provides control of the pair of rows of moveable hair retention elements 107*a* and 107*b*, enabling them to move upward, for example, when button 108 is pressed, and releasing button 108 retracts or returns the pair of rows of moveable hair retention elements 107*a* and 107*b* to their original positions. A representation of one deploying and retraction mechanism is provided in FIG. 6 herein.

The other components of hairbrush 101 are similar to existing styling hairbrushes, including heating elements positioned within brush head 104. The pair of rows of moveable hair retention elements 107*a* and 107*b* provide the ability to gently and easily hold the hair of the user in place while heat is applied without hair being positioned distant from the upper surface of brush head 104. In operation, the user turns on the hair brush 101 using power button 103, the inner components of the hair brush 101 heat up, the user draws hair through static protrusions such as static protrusions 105 and thicker static protrusions such as thicker static protrusion 106, or alternately applies the brush to her hair. The user then engages button 108, which encloses some of the hair within a relatively small triangular area formed between the static protrusions and the rows of moveable hair retention elements 107*a* and 107*b*. The user may then draw the brush away from her head, pulling her hair through the tightened openings between the movable hair retention elements and the protrusions. The user holds button 108, keeping the moveable hair retention elements 107*a* and 107*b* engaging the hair and the smaller triangular openings in place while drawing the brush away from her head. The hair is heated at a constant temperature and rate and results in a better overall styling effect.

While the term "user" is employed herein, use of this term is not intended to be limiting. For example, a user may style his or her own hair, but a person may use the device on another person, for example, such as a hair stylist using the device on a client or a parent using the device on a child. Use of the term "user" is thus not intended to limit the design or invention but is used as a representation of a single person use situation. In a dual individual setting, the user may be either the person holding the hair brush 101 or the person whose hair is being styled. An alternate terminology may be employed, such as a "styler" holding the device and a "recipient" receiving styling. Thus use of the word "user" herein may mean either person in a two person styling scenario.

Figure 2:
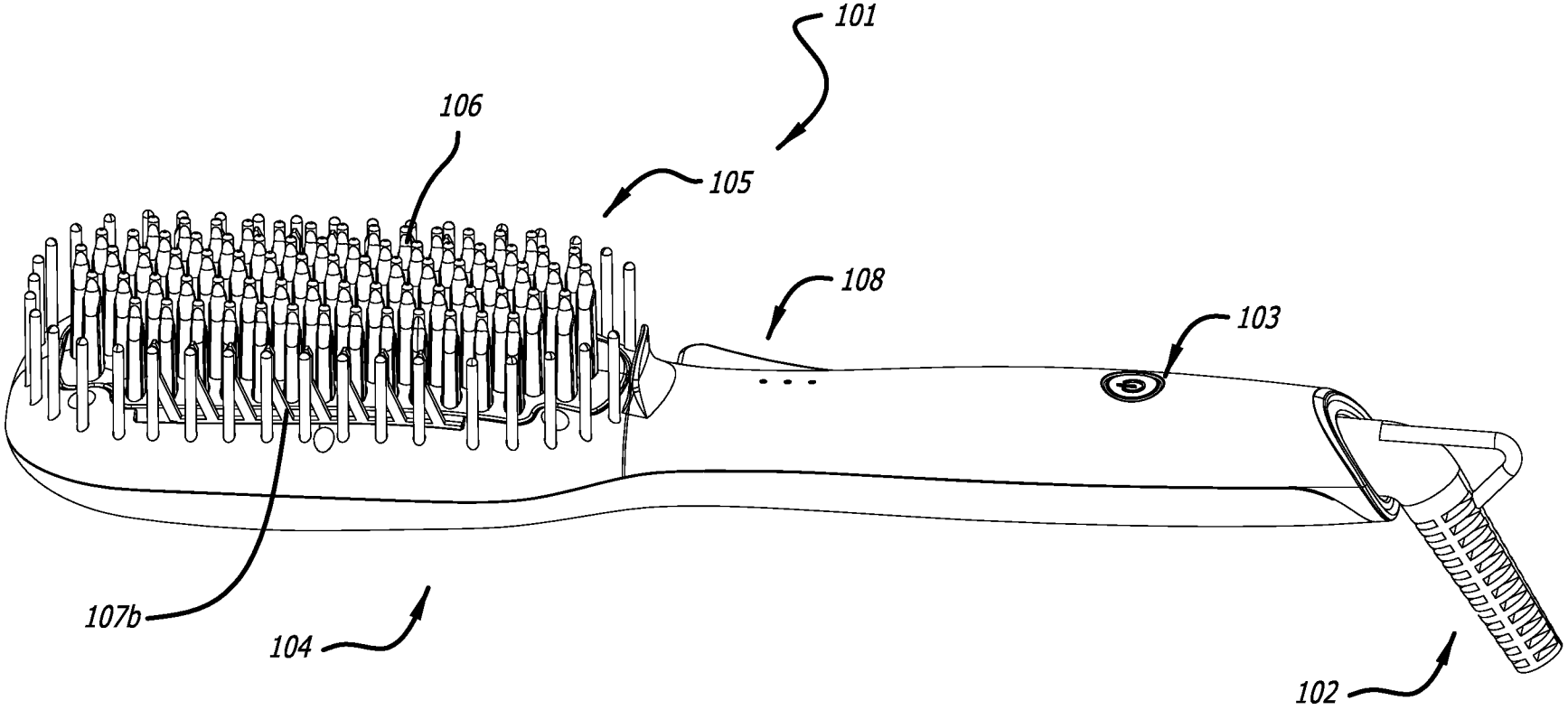
FIG. 2 is a side perspective view of an embodiment of the present design.
Figure 3:
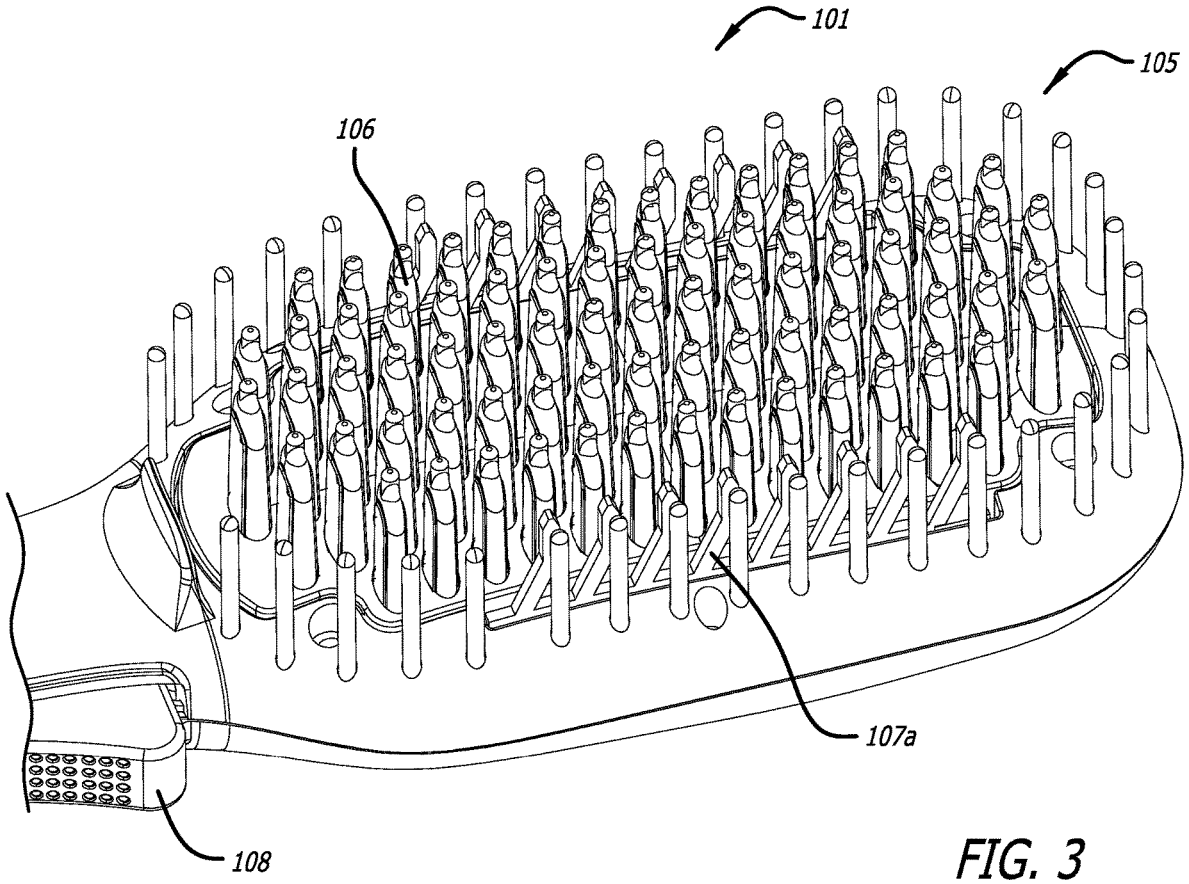
FIG. 3 is a close side perspective view of the brush head including the various tines or protrusions and the novel movable hair retention elements employed in this embodiment.

FIG. 2 is an alternate view of the present device, slightly rotated. Similar to FIG. 1, FIG. 2 illustrates styling brush or hair brush 101, power cord 102, power button 103, and brush head 104. Several static protrusions are provided, such as static protrusion 105, as well as a series of rows of thicker static protrusions, represented by thicker static protrusion 106. Also shown is one row of moveable hair retention elements 107*a* and button 108. FIG. 3 is a close view 107*b*.

The present design thus differs from previous designs in that the parallel rows of movable hair retention elements serve to collect the hair close to the heating element and allow for hair to be uniformly styled. Prior designs, such as that shown by U.S. Pat. No. 8,267,098, provide at least one unitary row of protrusions wherein clamping elements emanate from the protrusions to trap hair against the adjacent protrusion. The shape of the clamping elements provides a gap allowing an amount of hair to be collected. Such a design results in hair potentially moving when the brush is drawn away from the user's head, and hair is drawn in its collected state over a fairly narrow heating element, whereas the current design collects hair at two points and draws the hair over a larger heating area, providing more uniform styling.

FIG. 3 is a closer representation of the brush head showing brush head 104, static protrusions such as static protrusion 105, as well as a series of rows of thicker static protrusions, represented by thicker static protrusion 106. Also shown is one row of moveable hair retention elements 107*a* and button 108. The goal of the retention elements is to collect hair and maintain the hair close to the heating element.

Figure 4:
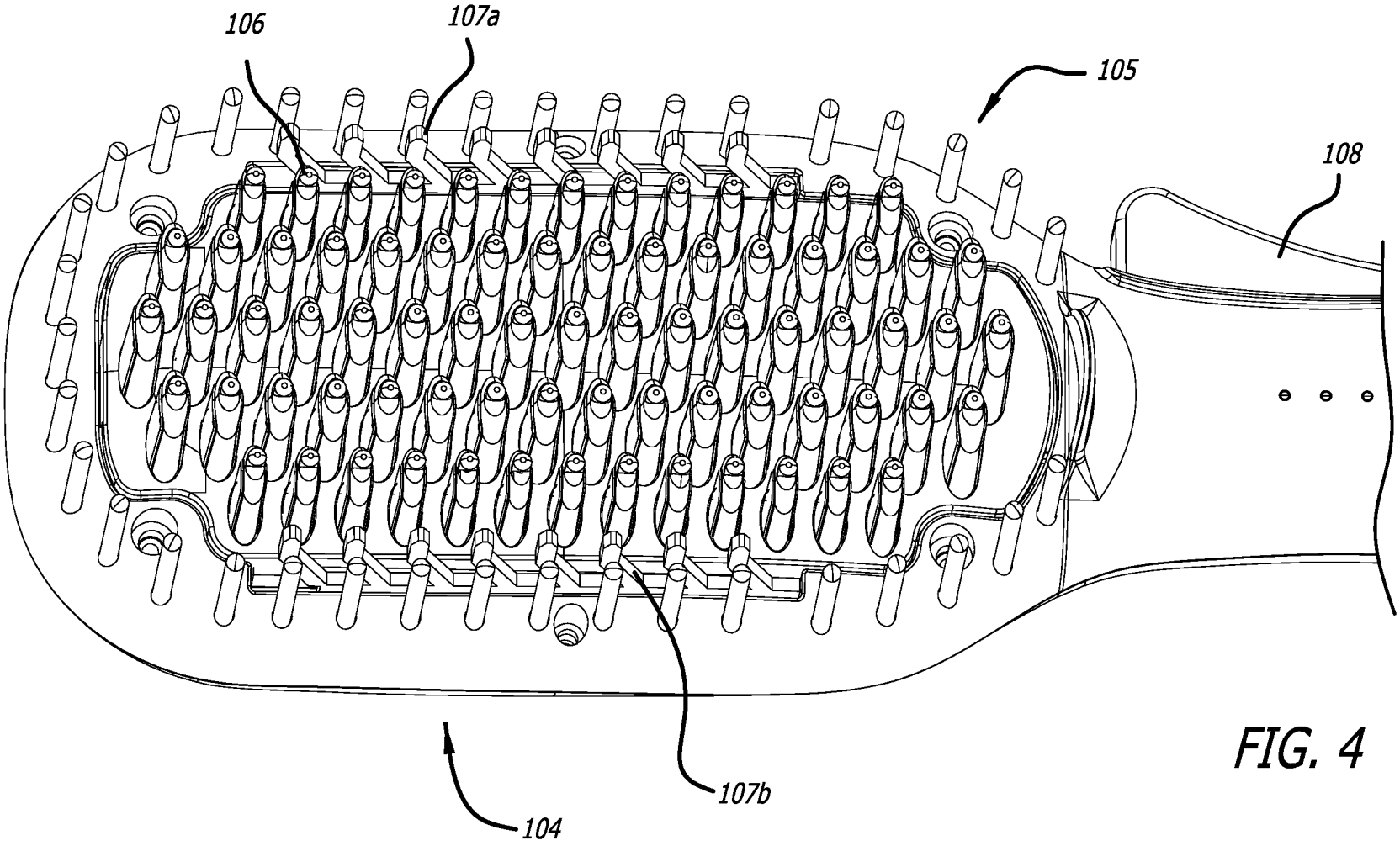
FIG. 4 shows a close top view of the brush head showing the various components provided in one embodiment of the current design.

FIG. 4 is a top view of brush head 104 showing the components of the design, including protrusions such as static protrusion 105, as a series of rows of the thicker static protrusions, represented by thicker static protrusion 106, and the two rows of moveable hair retention elements 107*a* and 107*b*. Also shown in this view is button 108.

Figure 5:
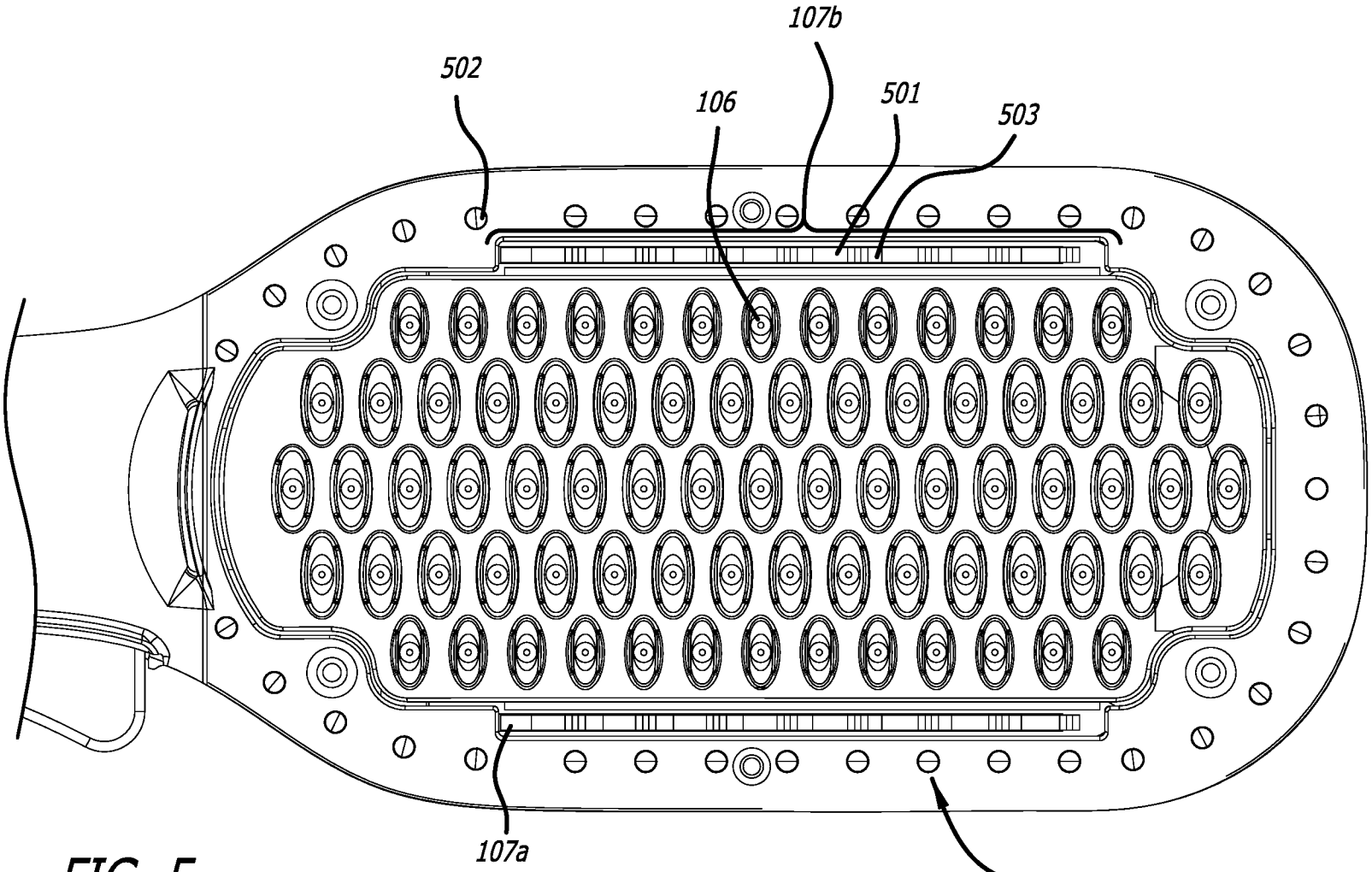
FIG. 5 is an even closer view showing the various tines or protrusions and the novel movable hair retention elements employed in this embodiment.

FIG. 5 is another top view of brush head 1-4, including protrusions such as static protrusion 105, a series of rows of thicker static protrusions, represented by thicker static protrusion 106, and the two rows of moveable hair retention elements 107*a* and 107*b*. As may be appreciated from FIG. 5 and as suggested or depicted in the previous drawings, the rows of moveable hair retention elements 107*a* and 107*b* include a series of prongs, such as prong 501, that is dimensioned to angle from base 502, or protrude from base 502 at an angle, such as 75 degrees, but other dimensions from 40 degrees to 85 degrees may be employed, where at a certain point the prong angles upward at basically an angle of 90 degrees from, or perpendicular to, base 502, to form an extension 503. Other arrangements may be employed, but in some instances the shape similar or identical to that depicted in FIG. 5 and the other drawings may enable the user to draw her hair through the movable hair retention elements, secure her hair close to the heating element, and successfully style her hair.

Button 108 may enable the user to retract or move the bases of the two rows of moveable hair retention elements 107*a* and 107*b*. Once moved or retracted, the rows may "lock" or become fixed, and in one embodiment pressing the other side of button 108, which may comprise a rocker button, the two rows of moveable hair retention elements 107*a* and 107*b* may move back to a start position. However, "locking" or securing is optional and not mandatory.

Figure 6:
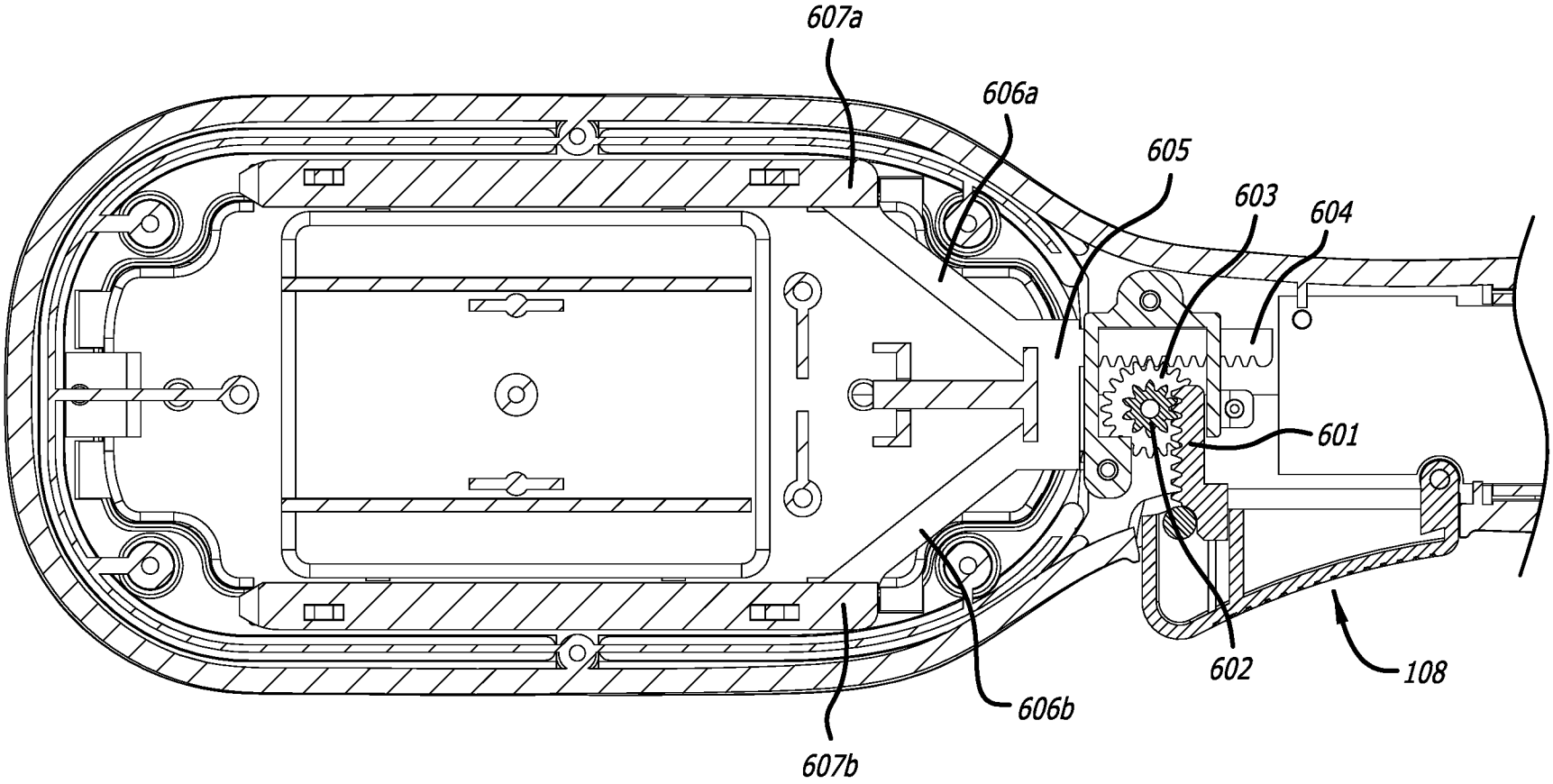
FIG. 6 illustrates the inner workings of the present design, including the components used in one embodiment to move the hair retention elements.

FIG. 6 illustrates the mechanical components employed in moving the two rows of moveable hair retention elements 107*a* and 107*b* and their respective bases using button 108. Button 108 is pressed in FIG. 6, moving slotted element 601 in an upward direction in the representation shown, which in turn rotates gear 602. Gear 602 is fixed to lower gear 603, and gear 602 and lower gear 603 are centered on the same axis, and thus rotation of gear 602 rotates lower gear 603, which drives rack 604 to the right in this view. Rack 604 moving to the right forces base element 605 to the right, which in turn forces arms 606*a* and 606*b* to the right in the orientation and depiction shown. Arms 606*a* and 606*b* move bases of hair retention elements 607*a* and 607*b* to the right in turn, thus moving the hair retention elements, securing the user's hair.

Button 108 may lock when depressed and may employ a spring to enable the button to be pressed again and thus unlocked or released to its original position. Again, the button may in some embodiments not lock, and may require the user to hold her thumb or otherwise depress button 108 to keep the hair retention elements in the styling position. In the case where button 108 offers a lockable feature and button 108 is released, the spring may serve to push the button 108 outward away from the brush head, resulting in slotted element 601 moving in a downward direction in the representation shown, which in turn rotates gear 602 counterclockwise. Counterclockwise rotation of gear 602 rotates lower gear 603 counterclockwise, which drives rack 604 to the left in this orientation. Rack 604 moving to the left pulls base element 605 to the left, which in turn pulls arms 606*a* and 606*b* to the left in the orientation shown in FIG. 6. Arms 606*a* and 606*b* move bases of hair retention elements 607*a* and 607*b* to the left, thus releasing the hair retention elements, or moving them to the left. The result is retraction of the hair retention elements such that the user may remove the brush from her hair.

While the representation of FIG. 6 illustrates a design or means for moving and retracting a set of elements, i.e. a movable part intended to facilitate securing the hair of the user, it is to be understood that other devices or designs may be employed, including but not limited to an electrical button or switch and/or alternate mechanical devices moving the base or any other construction of movable prongs, tines, or protrusions.

Figure 7A:
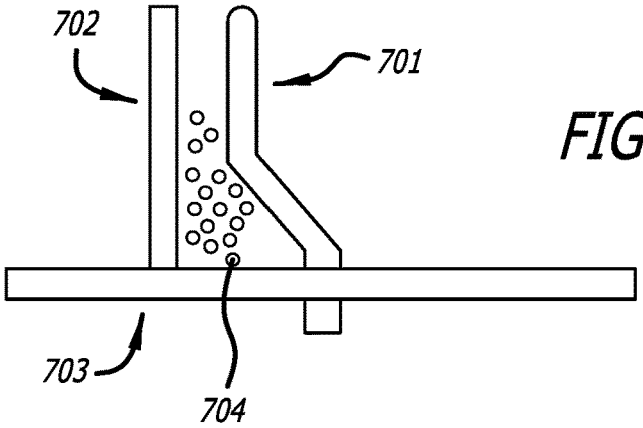
FIGS. 7A, 7B, and 7C conceptually illustrate beneficial operation according to the present design.
Figure 7B:
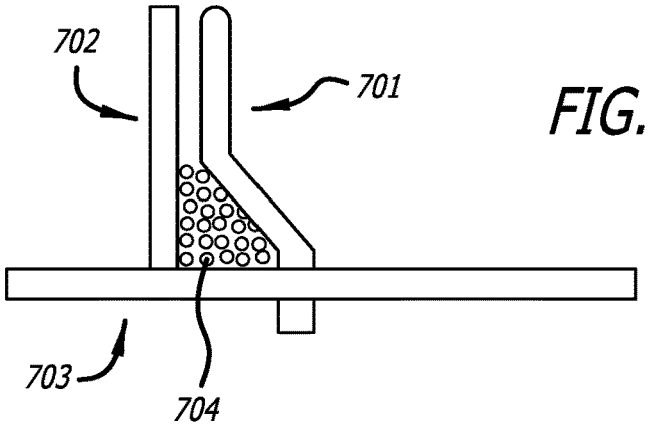
Figure 7C:
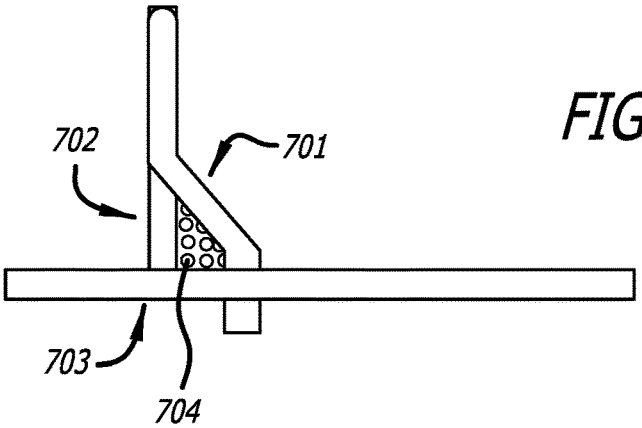

FIGS. 7A, 7B, and 7C illustrate the beneficial operation of the present design. From FIG. 7A, there is illustrated moving bristle 701 and fixed bristle 702, generally corresponding to one of the prongs of hair retention elements 107*a* and one of the static protrusions 105, respectively. The fixed bristle may alternately represent a larger internal element similar to thicker static protrusion 106. User hair 704 may be placed within the arrangement, where using an older type of device heating may not by applied to or received by some of the hair follicles more remotely positioned from brush surface 703. In this arrangement, without the button pushed, hair can drop or be placed into the brush with ease as with prior designs.

FIG. 7B shows partial pressing of the button and partial movement of moving bristle 701 toward fixed bristle 702. When this movement or clamping begins, hair of the user is trapped or maintained in the angled undercut as the moving bristles, such as moving bristle 701, move toward the adjacent fixed bristles. FIG. 7C shows substantial alignment between he upper portion of the moving bristle and, in this case, fixed bristle 702, with hairs further compacted as a result of further movement of moving bristle 701. Since the hair is now trapped or held in the undercut of moving bristle 701, hair 704 does not pull out or otherwise escape via the top as occurs when the hair 704 is not trapped and only being maintained by separated surfaces or bristles.

Again, while the general angle of moving bristle 701 in FIGS. 7A, 7B, and 7C has an angle of about 45 degrees from brush surface 703. This angle may vary, and is typically less than 85 degrees and more than 10 degrees, but other angles, such as angles between 35 and 55 degrees, may be employed.

According to the present design, there is provided a hair styling apparatus comprising a brush head, a plurality of tines located on the brush head, and a series of movable linearly arranged prongs having an angled orientation with respect to the brush head. A user causing movement of the linearly arranged prongs serves to secure the user's hair against a subset of the plurality of tines.

According to a further embodiment of the present design, there is provided a hair styling apparatus comprising a brush head, a plurality of tines disposed on the brush head, and a plurality of movable prongs emanating from the brush head, the plurality of movable prongs movable using a switch engageable by a user. The plurality of movable prongs is oriented in at least one linear configuration and is movable using the switch to secure and release hair of the user in conjunction with at least some of the plurality of tines.

According to another embodiment of the present design, there is provided a hair styling apparatus comprising a plurality of tines spaced apart on a brush head, and a plurality of prongs movable to secure a user's hair when the user's hair passes through at least some of the plurality of tines. The plurality of prongs are movable to secure and release the user's hair.

The devices, processes and features described herein are not exclusive of other devices, processes and features, and variations and additions may be implemented in accordance with the particular objectives to be achieved. For example, devices and processes as described herein may be integrated or interoperable with other devices and processes not described herein to provide further combinations of features, to operate concurrently within the same devices, or to serve other purposes. Thus it should be understood that the embodiments illustrated in the figures and described above are offered by way of example only. The invention is not limited to a particular embodiment, but extends to various modifications, combinations, and permutations that fall within the scope of the claims and their equivalents.

The design presented herein and the specific aspects illustrated are meant not to be limiting, but may include alternate components while still incorporating the teachings and benefits of the invention. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation.

What is claimed is:

1. A hair styling apparatus comprising:

a brush head;

a plurality of tines located on the brush head, the plurality of tines fixedly mounted to the brush head;

two bases oriented in parallel, each base of the two bases affixed with a plurality of movable linearly arranged prongs; and a rack and gear arrangement comprising a rack and a gear, the rack and gear arrangement connected to the two bases affixed with the plurality of movable linearly arranged prongs and actuatable by a user;

wherein the plurality of movable linearly arranged prongs comprises a plurality of hair capturing prongs formed of two integrally formed linear segments of equivalent thickness, each hair capturing prong comprising:

a lower angled linear segment comprising a lower angled linear segment bottom and a lower angled linear segment top, the lower angled linear segment bottom nonperpendicularly formed to one base of said two bases, and the lower angled linear segment extending in a straight line from said one base; and an upper vertically oriented linear segment comprising an upper vertically oriented linear segment base angularly formed to the lower angled linear segment top such that the upper vertically oriented linear segment is perpendicular to the one base.

2. The hair styling apparatus of claim 1, wherein the plurality of tines comprises an inner set of tines comprising at least three parallel rows of inner tines positioned atop a central region of the brush head and an outer set of tines positioned proximate a periphery of the brush head.

3. The hair styling apparatus of claim 2, wherein each base of the two bases is provided with the brush head between the inner set of tines and the outer set of tines.

4. The hair styling apparatus of claim 2, wherein the outer set of tines comprises a set of narrow exterior tines and the inner set of tines comprises a plurality of thicker internal tines.

5. The hair styling apparatus of claim 1, wherein each prong of the plurality of movable linearly arranged prongs comprises an extension provided at a nonperpendicular angle with respect to its respective base.

6. The hair styling apparatus of claim 5, wherein each prong of the plurality of movable linearly arranged prongs comprises a top portion formed atop the extension at an angle perpendicular with respect to its respective base.

7. The hair styling apparatus of claim 1, wherein the plurality of tines comprises an inner set of tines comprising at least three parallel rows of inner tines and an outer encircling set of tines positioned proximate a periphery of the brush head.

8. The hair styling apparatus of claim 1, further comprising a button engageable by the user to actuate the rack and gear arrangement, wherein the button operates with a locking and unlocking feature such that full depression of the button moves the plurality of movable linearly arranged prongs to a locked position.

9. A hair styling apparatus comprising:

a brush head;

a plurality of tines disposed on the brush head, the plurality of tines fixedly mounted to the brush head; and two bases oriented in parallel on the brush head, each base of the two bases affixed with a plurality of movable prongs, the two bases and the plurality of movable prongs movable using a a rack and gear arrangement comprising a rack and a gear, the rack and gear arrangement connected to the two bases and engageable by a user;

wherein the plurality of movable prongs comprises a plurality of hair capturing prongs formed of two integrally formed linear segments of equivalent thickness, each hair capturing prong comprising:

a lower angled linear segment comprising a lower angled linear segment bottom and a lower angled linear segment top, the lower angled linear segment bottom nonperpendicularly formed to one base of the two bases and extending in a straight line from the one base; and an upper vertically oriented linear segment comprising an upper vertically oriented linear segment base angularly formed to the lower angled linear segment top such that the upper vertically oriented linear segment is perpendicular to the one base.

10. The hair styling apparatus of claim 9, wherein the plurality of tines comprises an inner set of tines comprising at least three parallel rows of inner tines positioned atop a central region of the brush head and an outer set of tines positioned proximate a periphery of the brush head.

11. The hair styling apparatus of claim 10, wherein the the rack and gear arrangement comprises a rack element that interfaces with a button that causes the rack element to move and rotate a gear element.

12. The hair styling apparatus of claim 10, wherein the outer set of tines comprises a set of narrow exterior tines and the inner set of tines comprises a plurality of thicker internal tines.

13. The hair styling apparatus of claim 9, wherein each lower angled linear segment is provided at a nonperpendicular and nonparallel angle with respect to its respective base.

14. The hair styling apparatus of claim 13, wherein each upper vertically oriented linear segment is provided above the base at a position linearly offset from a joining point between the lower angled linear segment and its respective base.

15. The hair styling apparatus of claim 9, wherein the rack and gear arrangement is actuatable by a user engageable button having a locking and unlocking feature such that full depression of the user engageable button causes rotation of a gear such that the plurality of movable prongs moves to a locked position.

16. The hair styling apparatus of claim 9, wherein the wherein the rack and gear arrangement is user engageable using a button.

17. A hair styling apparatus comprising:

a plurality of tines spaced apart on a brush head, the plurality of tines fixedly mounted to the brush head;

two bases oriented in parallel on the brush head, each base of the two bases affixed with a plurality of prongs movable to secure hair when the hair passes through at least some of the plurality of tines; and a rack and gear arrangement comprising a rack and a gear, the rack and gear arrangement connected to the two bases and actuatable by a user;

wherein the plurality of prongs comprises a plurality of hair capturing prongs formed of two integrally formed linear segments of equivalent thickness, each hair capturing prong comprising:

a lower angled linear segment comprising a lower angled linear segment bottom and a lower angled linear segment top, the lower angled linear segment bottom nonperpendicularly formed to one base of the two bases and extending in a straight line from the one base; and an upper vertically oriented linear segment comprising an upper vertically oriented linear segment base angularly formed to the lower angled linear segment top such that the upper vertically oriented linear segment is perpendicular to the one base.

18. The hair styling apparatus of claim 17, wherein the plurality of prongs comprises multiple hair capturing prongs linearly arranged on one base of the two bases.

19. The hair styling apparatus of claim 18, wherein the plurality of tines comprises:

an inner set of linearly arranged tines mounted to the brush head; and an outer set of tines mounted about the periphery of the brush head and shaped differently than the inner set of linearly arranged tines.

20. The hair styling apparatus of claim 19, wherein the inner set of tines is positioned between the two bases and the two bases are located between the inner set of tines and the outer set of tines.

* * * * *